US005733165A

United States Patent [19]

Kelley

[11] Patent Number: 5,733,165

[45] Date of Patent: Mar. 31, 1998

[54] PLAY-INSIDE PLAY STRUCTURE

[75] Inventor: Miriam Kelley, Buffalo, N.Y.

[73] Assignee: Fisher-Price Inc., E. Aurora, N.Y.

[21] Appl. No.: 598,042

[22] Filed: Feb. 7, 1996

[51] Int. Cl.[6] ..... A63H 3/52

[52] U.S. Cl. ..... 446/73; 446/71; 446/478

[58] Field of Search ..... 446/71–73, 146, 446/476, 478, 479

[56] References Cited

U.S. PATENT DOCUMENTS

| | | | |
|---|---|---|---|
| D. 326,689 | 6/1992 | Farinelli, Jr. | D21/114 |
| D. 333,328 | 2/1993 | Aker et al. | D21/114 |
| D. 340,098 | 10/1993 | Petersheim | D21/242 |
| D. 340,099 | 10/1993 | Warren et al. | D21/243 |
| D. 340,956 | 11/1993 | Temple | 446/476 |
| D. 340,960 | 11/1993 | Phinney et al. | D21/189 |
| D. 344,121 | 2/1994 | Warren | D21/240 |
| D. 344,770 | 3/1994 | Swiderski | D21/114 |
| D. 348,988 | 7/1994 | Bro et al. | D6/331 |
| 1,241,594 | 10/1917 | Williams . | |
| 1,343,065 | 6/1920 | Suyehiro . | |
| 4,021,960 | 5/1977 | Walmer . | |
| 4,205,482 | 6/1980 | Christiansen et al. | 446/128 |
| 4,523,418 | 6/1985 | McLaughlin | 446/478 |
| 4,696,652 | 9/1987 | Reeder et al. | 446/75 |
| 4,992,068 | 2/1991 | Conrad | 446/478 |
| 5,004,445 | 4/1991 | Coleman et al. | 446/478 |
| 5,265,848 | 11/1993 | Michaud et al. | 446/478 |
| 5,313,747 | 5/1994 | Sakihara | 446/478 |
| 5,330,379 | 7/1994 | Roh et al. | 446/71 |
| 5,352,149 | 10/1994 | Melashenko et al. | 446/490 |
| 5,354,589 | 10/1994 | Wass | 428/61 |
| 5,435,769 | 7/1995 | Bertrand | 446/476 |
| 5,544,870 | 8/1996 | Kelley et al. | 446/478 |

FOREIGN PATENT DOCUMENTS

| | | | |
|---|---|---|---|
| 2241326 | 3/1975 | France | 446/476 |
| 3203600 | 9/1983 | Germany | 446/479 |
| 613628 | 10/1979 | Switzerland | 446/476 |

OTHER PUBLICATIONS

Playskool Toy Fair '91, "Flat Folks™ House".

Playskool Toy Fair '91, "Flat Folks™ City" & Flat Folks™ Farm.

Fisher–Price, Inc. Toy Fair 1996, Dream Doll House™, p. 76.

Little Tikes: Toys That Last, 1994, "Little Tikes® Place", p. 31.

Little Tikes: Toys That Last, 1994,"Little Tikes® Place Stable". p. 31.

Little Tikes Toys That Last, 1994, "Grandma's House".

Little Tikes: Toys That Last, 1994, "Toddle Tots® Community Playground", p. 11.

Little Tikes: Toys That Last, 1994, "Toddle Tots® Petting Farm & Zoo", p. 12.

Little Tikes: Toys That Last, 1994, "Toddle Tots® Dinosaur Mountain", p. 13.

(List continued on next page.)

*Primary Examiner*—Robert A. Hafer

*Assistant Examiner*—Jeffrey D. Carlson

*Attorney, Agent, or Firm*—Morgan, Lewis & Bockius LLP; C. Scott Talbot

[57] ABSTRACT

A play-inside play structure comprising a plurality of wall members, a door panel and a roof securely connectable to form a substantially enclosed play structure, said play structure having an interior space sufficiently large to accommodate at least one child therein, and said wall members, door panel and roof having a plurality of play surfaces thereon for small cars, trucks, play or action figures. The play structure and play surfaces are related in appearance, such that they both revolve around a central theme to create a synergistic imaginative and role playing effect. In the preferred embodiment, the play structure resembles a schoolhouse and the play surfaces include, but are not limited to, a functional blackboard, molded-in classroom and cafeteria areas, library, gym, swimming pool area, picnic area, slides, ladders, tunnels, school crossing signals, and playground area including a merry-go-round, hanging tires, and hopscotch outline.

38 Claims, 9 Drawing Sheets

OTHER PUBLICATIONS

Little Tikes: Toys That Last, 1994, "Pirate Ship Climber", p. 55.
Little Tikes: Toys That Last, 1994, "Country Cottage", p. 59.
Little Tikes: Toys That Last, 1994, "Log Cabin" & Castle, p. 56.
Little Tikes: Toys That Last, 1994, "Evergreen® Play House", p. 57.
Little Tykes, Toys That Last, 1994 "Super Storage Easel", p. 25.
Little Tykes, Toys That Last, 1994, "Big Dollhouse", p. 34.
Little Tykes, Toys That Last, 1994, "Storybook Cottage, Twin Bed", p. 71.
Little Tykes, Toys That Last, 1994, "Cozy Cottage, Toddler Bed", p. 71.
Little Tikes: Toys That Last, 1995, "Giant Action Figure Castle", p. 28.
Little Tikes: Toys That Last, 1995, "Grand Mansion", pp. 47–48.
Little Tikes: Toys That Last, 1995, "Tike Activity Barnyard™".
Little Tikes: Toys That Last, 1995, "Activity Garden", p. 8.
Today's Kids, Wish Book, 1994, "Play'n Fold™ Clubhouse", p. 6.
Today's Kids, Wishbook 1994, "Infant–Toddler Playland", p. 10.
Today's Kids, Wish Book, 1994, "Toddler Playground", p. 9.
Step 2, A Step Beyond, 1994, "Drive–In Playhouse", p. 22.
TYCO Playtime, 1995, "Color 'n Carry", p. 55.
TYCO Playtime, 1995, "Creative Art Center", p. 56.
Flexible Flyer Company, Cozy Condo™ Playhouse.

PLAY-INSIDE PLAY STRUCTURE

The present invention relates generally to a play structure for children. More specifically, the invention relates to a play structure having a plurality of play surfaces for small play or action figures thereon and having an interior space sufficiently large to accommodate one or more children inside the play structure.

BACKGROUND OF THE INVENTION

Play structures for small play or action figures are well known. Typically, the play structures have a central theme, such as a barn, house or cave, and are relatively small enclosed structures. The size of a typical play structure is generally such that small children may insert their hands, together with a play or action figure into the play structure. Examples of such structures include the Little Tikes® Place, Stable, Grand Mansion and Grandma's House. In addition to being relatively small and having limited access to the interior, such play structures are typically rather intricate and difficult to assemble.

Larger play structures such as the Fisher-Price Dream Doll House™ and Little Tikes® Big Doll House which measure approximately two to three feet tall, are generally a cross-section of a structure such as a house, wherein children can play with small play or action figures either on the outside facade of the structure or in the interior cut-away. These prior art play structures are typically designed to be placed on a table-top or floor and do not allow children entry into the house or structure.

Allowing children to enter and exit a play structure adds a desirable realism dimension to children's play experience. Further, a "play-inside" play structure would produce a beneficial synergistic effect, as the child could mimic the actions of its play or action figures. Such a play structure would advantageously permit both imaginative play with the play figures and role playing by the child in the play structure itself.

SUMMARY OF THE INVENTION

The present invention overcomes the shortcomings of prior art. The play-inside play structure of the present invention contains a plurality of play surfaces throughout and is sufficiently large to accommodate one or more children inside, thereby allowing children to enter and exit the play structure. The disclosed play-inside play structure provides both exterior and interior play surfaces, both of which are easily accessible to children. Unlike the prior art, the play structure of the present invention permits children to play inside the structure with their play or action figures, thereby adding to their enjoyment. The play structure and play surfaces may both incorporate features having a single, central theme, such that a child could itself, in the play structure, mimic the actions of the play figures on the play surfaces.

DETAILED DESCRIPTION

Figure 1:
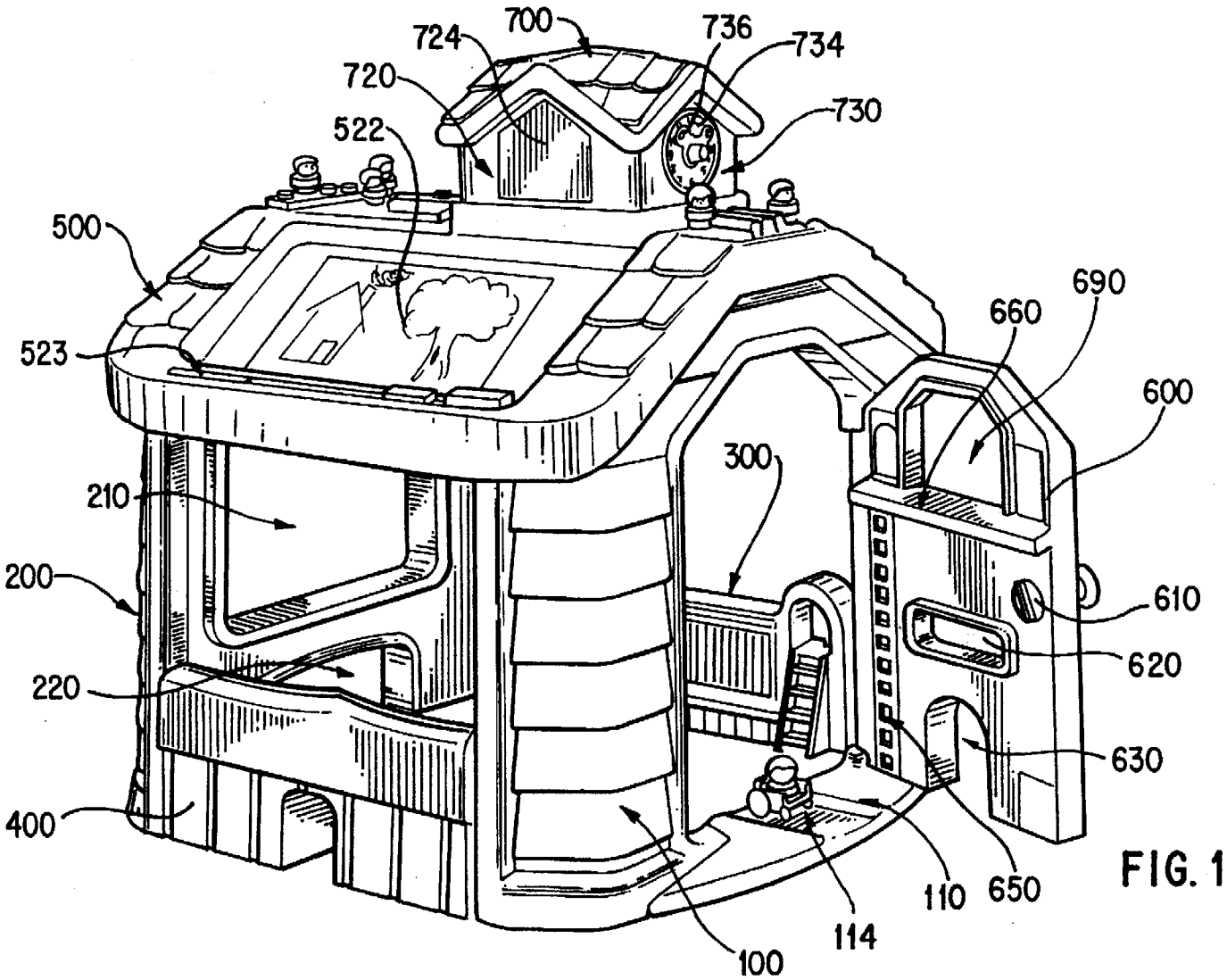
FIG. 1 is a front perspective view of the exterior of the play-inside play structure ("play structure") assembled in accordance with the principles of the present invention.
Figure 2:
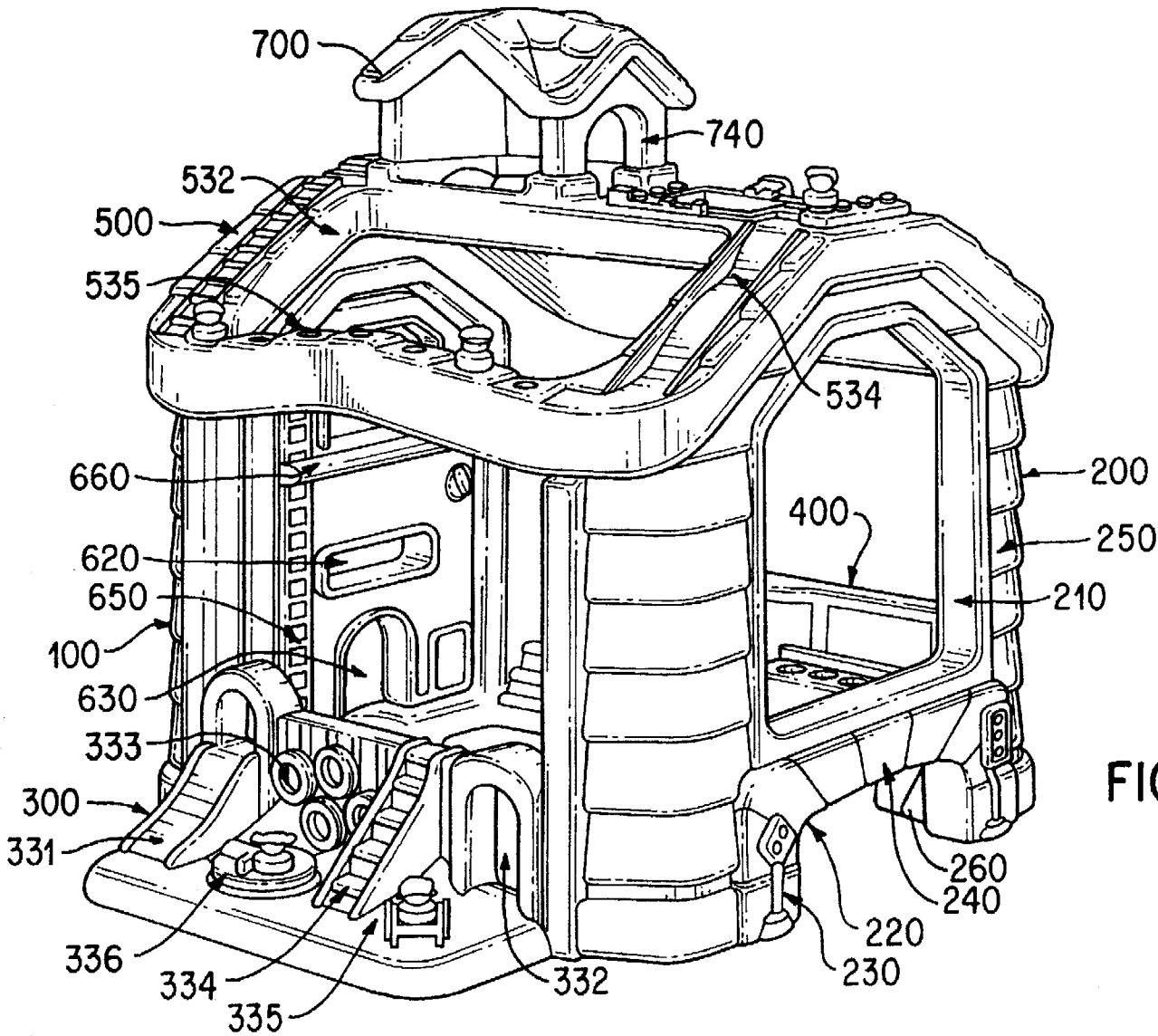
FIG. 2 is rear perspective view of the exterior of the assembled play structure.

A play structure embodying the principles of the present invention is illustrated in FIGS. 1–9. As seen in FIGS. 1 and 2, the play structure preferably includes a front wall (100), a rear wall (200), a right side wall (300), a left side wall (400), a roof (500), a door panel (600), a roof attachment (700). Each of these components can include one or more integrally molded play surfaces thereon. These play surfaces, which may include raised cylindrical pegs and circular recesses (800), are specifically contemplated for use with Fisher-Price Little People®, which are small plastic play figures having a circular base with a circular indentation or recess in the center thereof. Fisher Price Little People® are disclosed in U.S. Pat. No. 340,960.

Figure 5A:
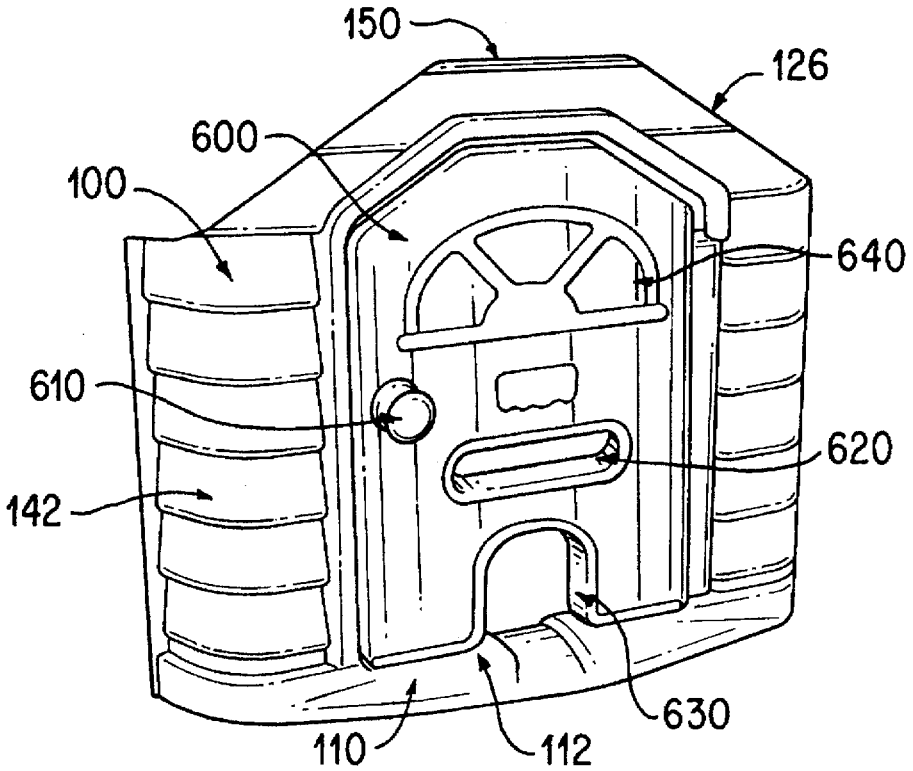
FIG. 5A is a perspective view of the exterior of the front wall member.
Figure 5B:
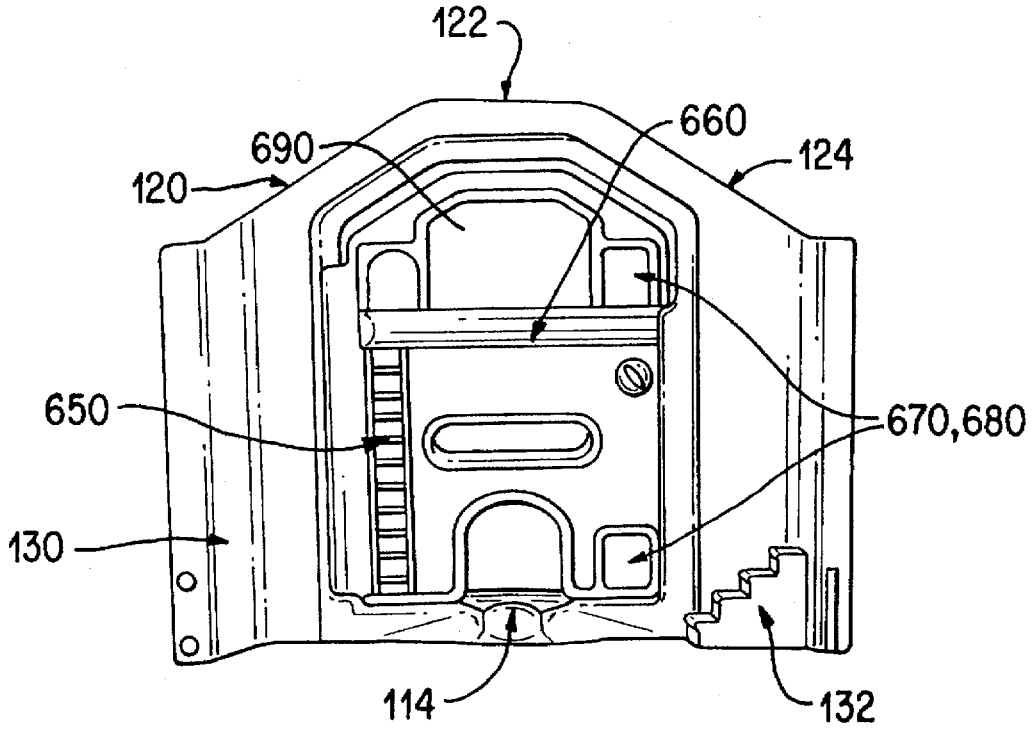
FIG. 5B is a close-up view of the interior of the front wall member.

As depicted in FIGS. 5A and 5B, the front wall comprises a base (110), a top edge (120), an interior surface (130), and an exterior surface (140). The front wall extends around the right and left corners to form a portion of a side wall, has a doorway opening (150), and realistic siding (142) on its exterior surface. The base (110) of the front wall extends under the door opening (150) and includes, on its upper surface (112), a recessed track (114) for small vehicles. The interior (130) of the front wall includes a small stair case (132). The top edge (120) of the front wall is shaped to fit securely to the roof (500) and therefore has substantially horizontal portion (122) and two sloping side portions (124, 126).

The door panel (600) is mounted to the door opening (150) by a hinge or any other suitable means. The door panel (600) preferably includes a door knob (610), mail slot (620) and an inverted U-shaped cut-out (630) on the lower end thereof. Cut-out (630), which is located directly above the recessed track (114) in the base of the front wall, provides a pathway for small cars, truck or play figures into and out of the play structure while the door panel (600) is in its closed position.

On the exterior side of the door panel (600) is a molded-in decorative archway pattern (640). On the interior side of the door panel is a molded-in ladder (650) leading to horizontal ledge (660), and an outline of an upper and lower elevator door (670, 680). The ledge (660) provides a platform on which play figures may be placed. A decal depicting a library scene (690) is affixed to a portion of the interior door panel above the ledge (660).

Figure 3A:
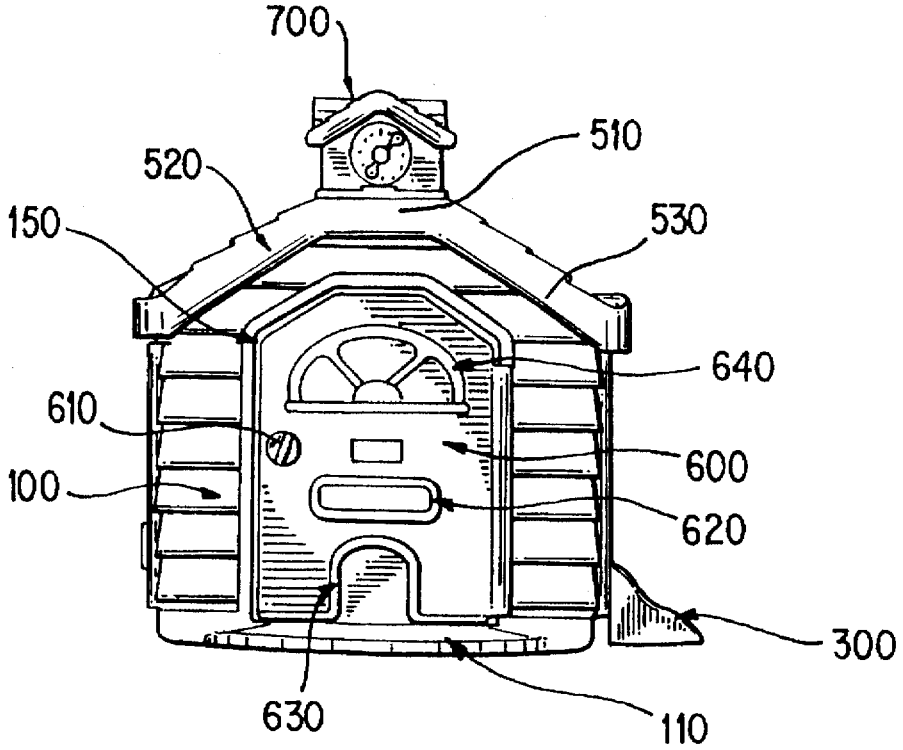
FIG. 3A is front view of the exterior of the assembled play structure.
Figure 3B:
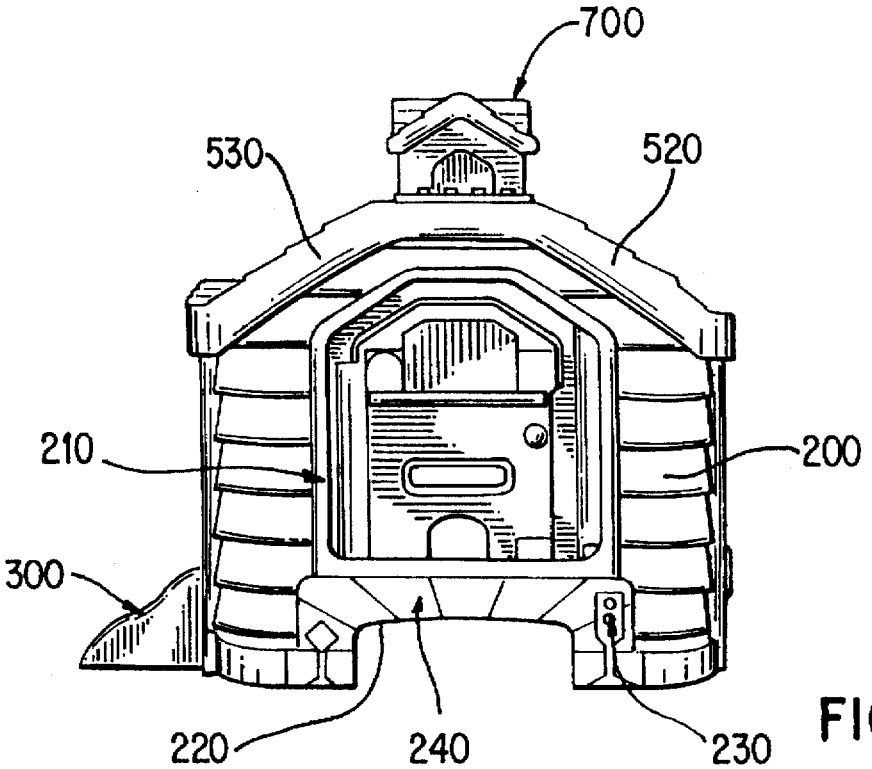
FIG. 3B is rear view of the exterior of the assembled play structure.
Figure 4A:
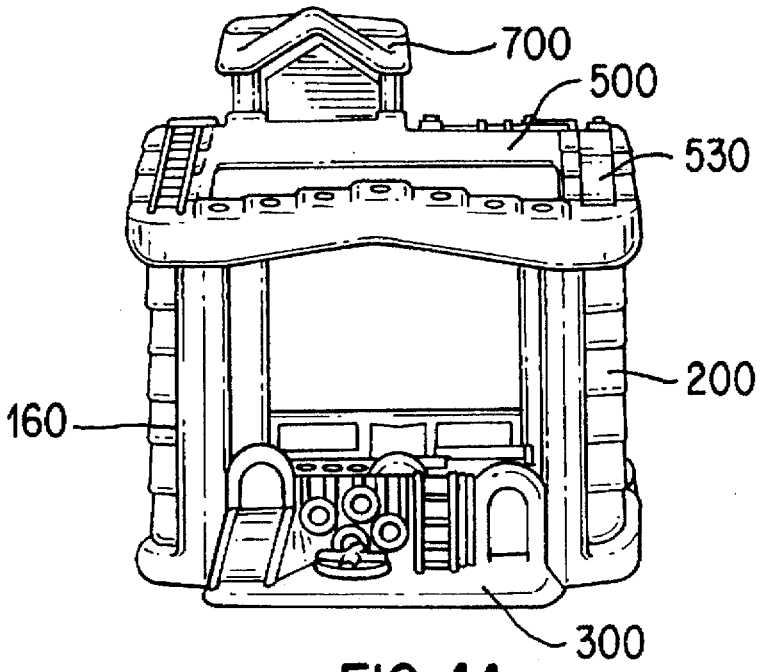
FIG. 4A is a right view of the exterior of the assembled play structure.
Figure 4B:
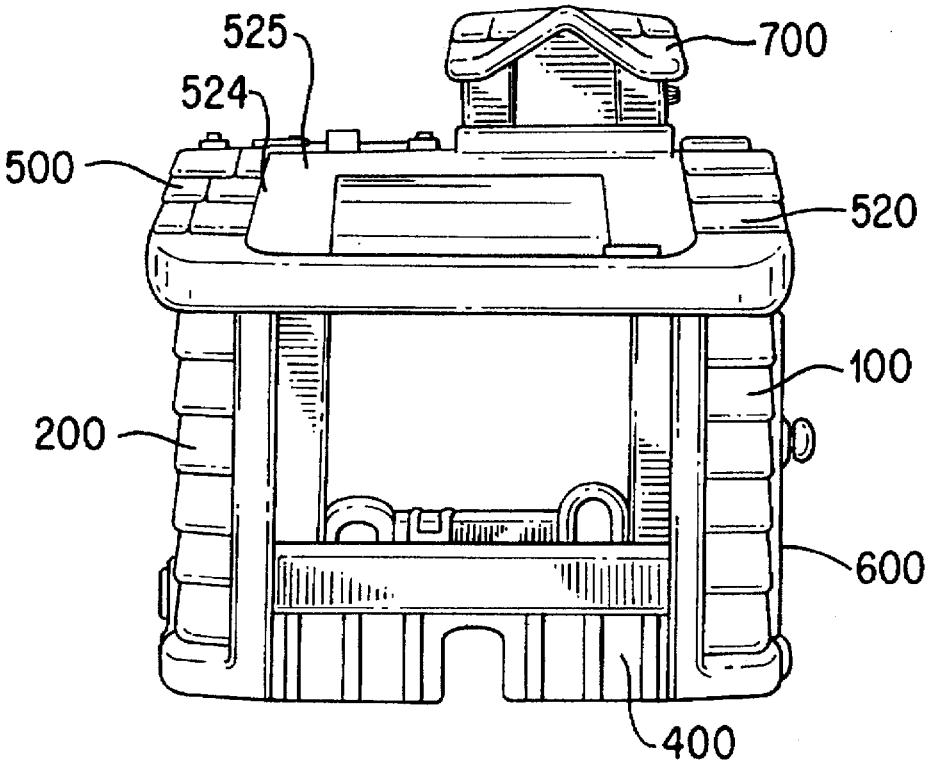
FIG. 4B is a left view of the exterior of the assembled play structure.

As seen in FIGS. 2 and 3B, the rear wall (200) of the play structure preferably includes a large window cut-out (210) and a lower elongated archway (220) for entry and exit of small cars, trucks and play or action figures. The exterior side of the rear wall has molded-in traffic signals (230) and a realistic stone archway perimeter (240). The interior side of the rear wall includes a ramp (260) which leads to the planar upper level (423) on the interior (420) of the left side wall (400). Similar to the front wall, the rear wall also extends around the right and left corners, thereby forming a portion of each side wall. The exterior of the rear wall also has realistic siding (250).

The side walls (300,400) preferably do not extend up to, or connect to, the roof (500). Instead, the side walls are much shorter and wider at their base to provide larger and more accessible play surfaces on both the exterior and interior portions of the side walls.

Figure 6A:
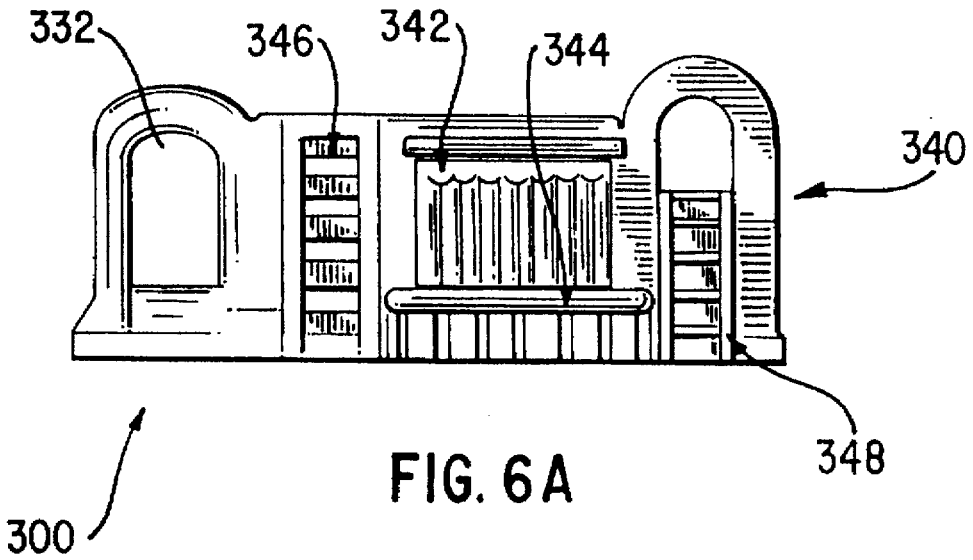
FIG. 6A is a close-up view of the interior of the right wall member.
Figure 6B:
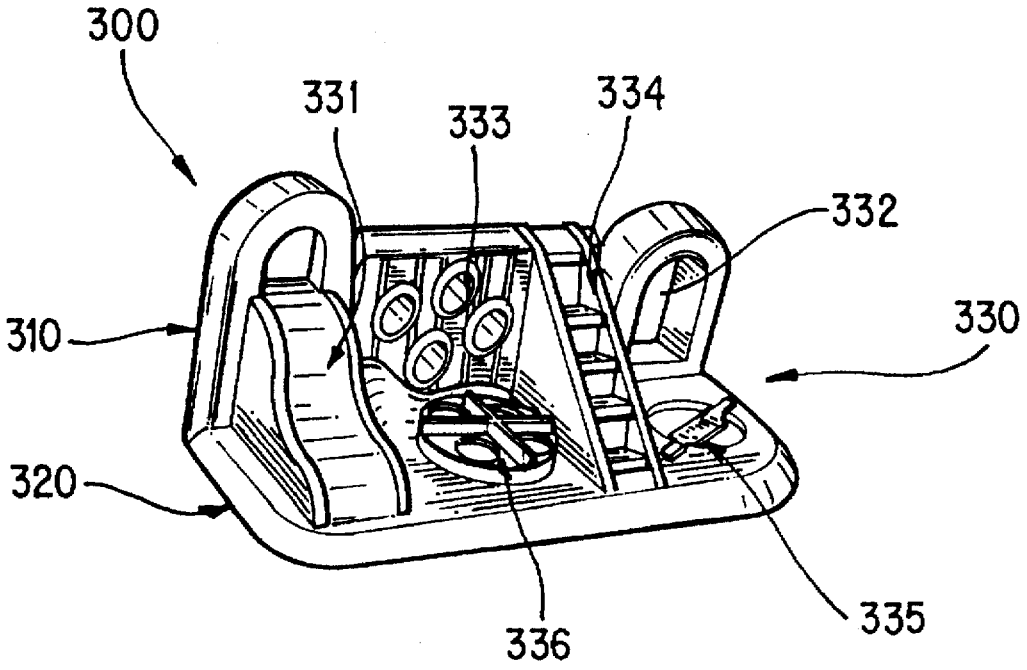
FIG. 6B is a front perspective view of the exterior of the right wall member.

As depicted in FIGS. 2, 6A and 6B, the right side wall (300) is substantially L-shaped, with the vertical portion (310) abutting, and connecting to, the vertical edges of the front and rear walls (100, 200) and the horizontal portion (320) of the "L" extending away from the play structure. The exterior portion of the right side wall (330), has molded thereon a playground scene, including a molded-in slide (331), pass-though tunnel (332), hanging tires (333), ladder (334) and hopscotch outline (335). A circular merry-go-round (336), having a plurality of circular recessed portions to accommodate the base of certain play figures, is affixed thereto. The merry-go-round (336) rotates around a central vertical axis, and any suitable means to effect this motion is contemplated.

The interior portion of the right side wall (340) comprises another play surface. A large decal (342) depicting stage curtains, with a small child peering through, is affixed to the vertical portion of the interior right side wall (340). At the lower edge of the decal is a molded-in horizontal ledge (344), which together with the decal (342), depicts a stage area for play figures. On either side of the stage ledge are molded-in ladders (346, 348) which connect at their upper end to the slide (331) and the ladder (334) on the exterior portion (330) of the right side wall, respectively.

Figure 7A:
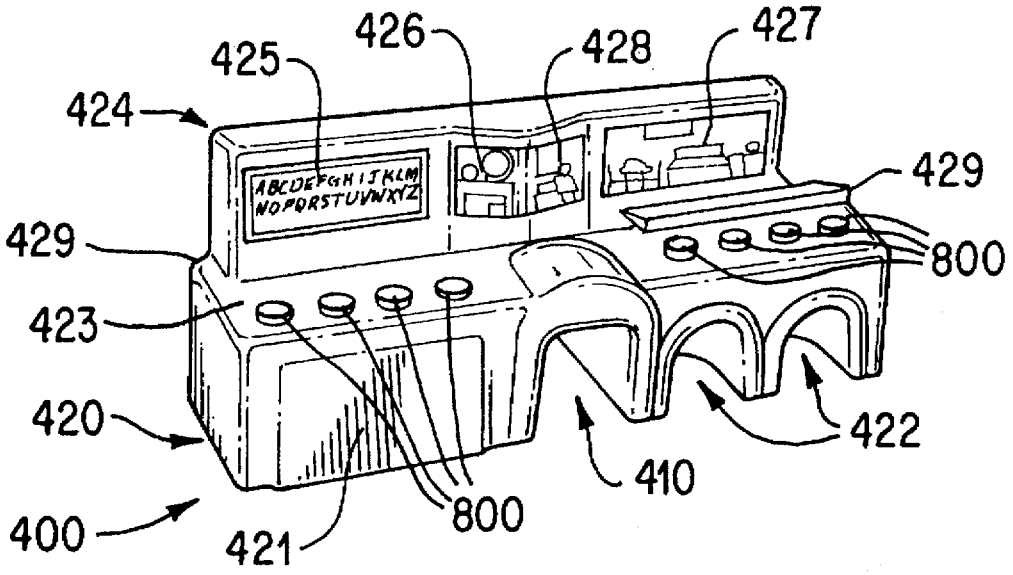
FIG. 7A is a front perspective view of the interior of the left wall member.
Figure 7B:
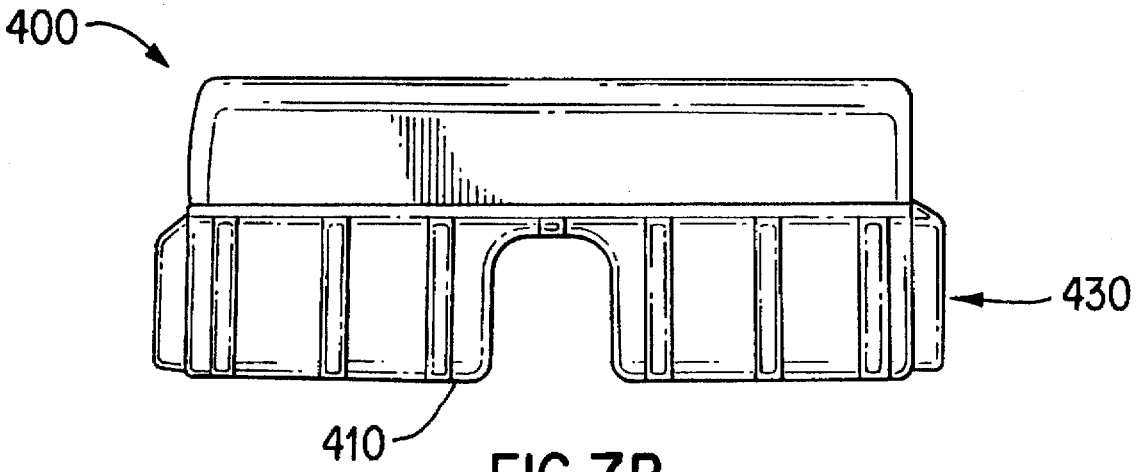
FIG. 7B is a close-up view of the exterior of the right wall member.

As seen in FIGS. 7A & B, the left side wall (400) also provides additional play surfaces. An inverted U-shaped tunnel (410), which allows small cars, trucks and play figures to pass through from the exterior to the interior of the play structure, extends therethrough. The interior of the left side (420) wall has a series of molded-in locker panels (421) and recessed archways (422), both located near the lower portion of the interior wall (420). Above the locker panels and recessed archways is a horizontal, substantially planar upper level (423), having thereon a series of molded-in circular recesses (800) adapted to fit the base of certain play figures. A vertical wall (424), which extends upward from the exterior side of this level, has a series of decals thereon depicting various classroom scenes, includes a chalkboard (425), a desk (426), a cafeteria (427) and a cash register (428). Between the vertical wall (424) and the recesses/seats (800) are molded-in elongated table surfaces (429). The decals (425–428), together with the circular recesses/seats (800) and the table surfaces (429), combine to form a classroom/cafeteria play area.

Figure 8A:
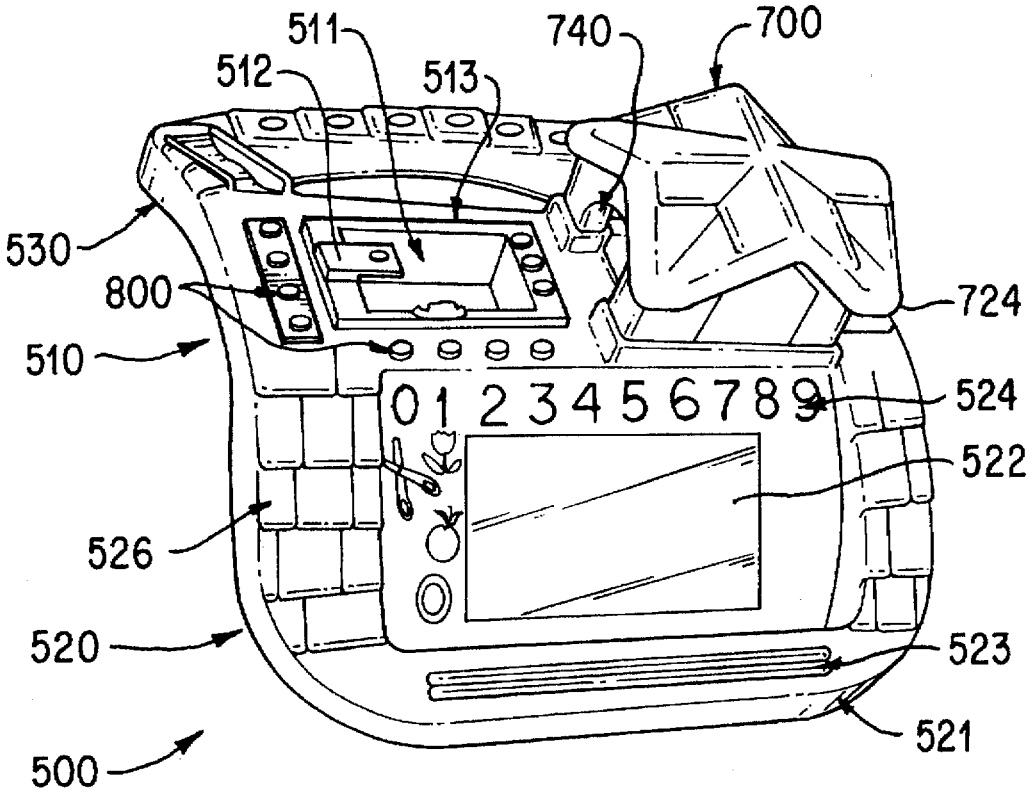
FIG. 8A is a perspective plan view of the exterior of the roof.
Figure 8B:
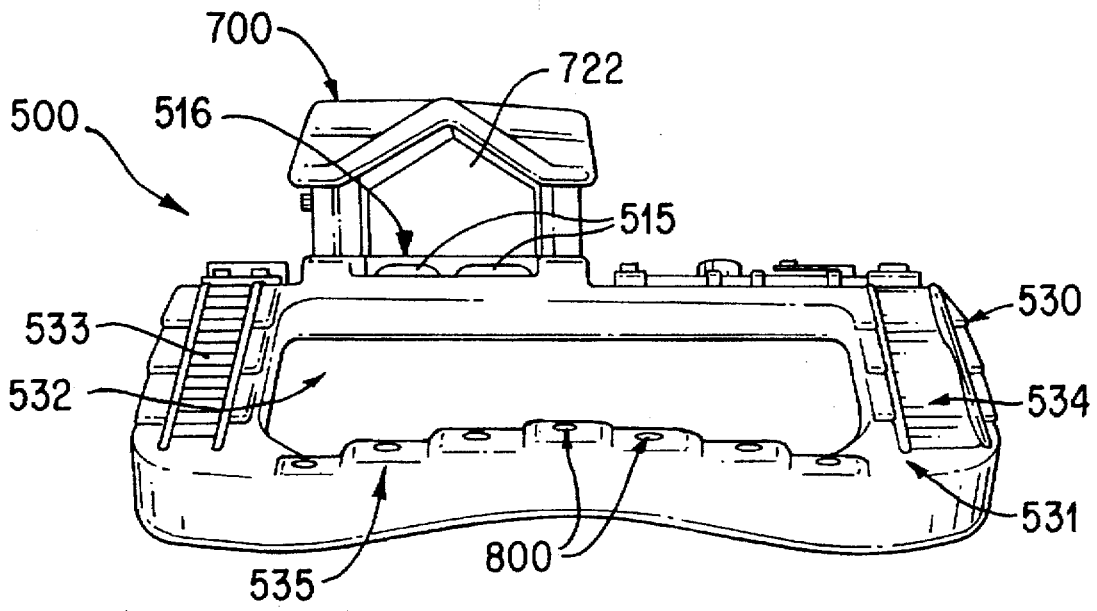
FIG. 8B is a close-up view of the exterior left downward sloping section of the roof.
Figure 9A:
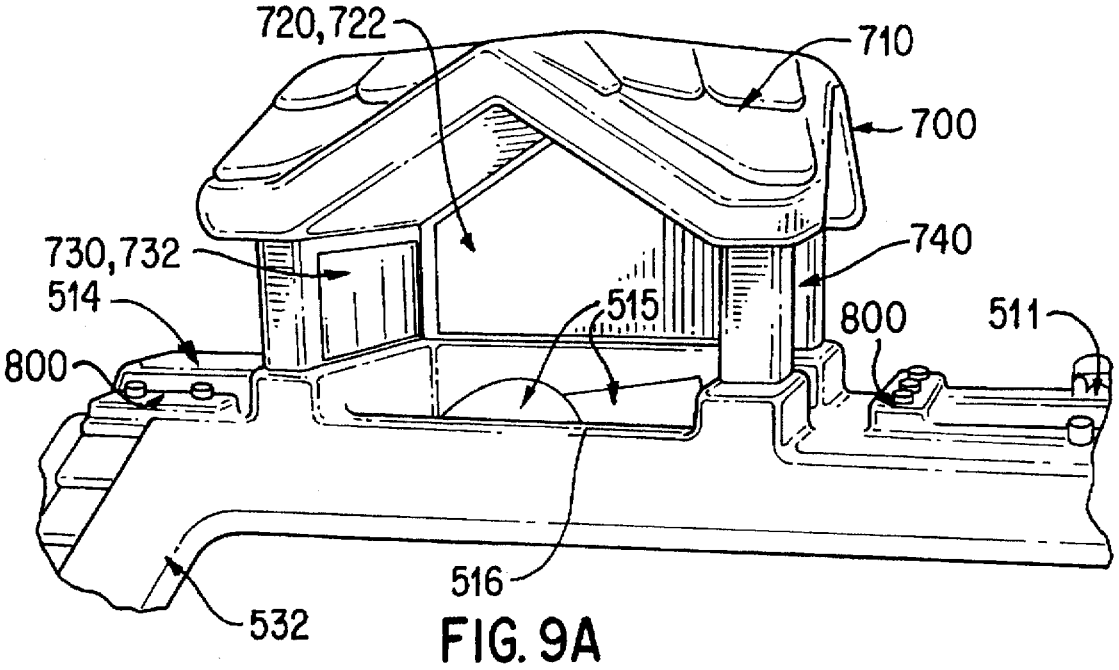
FIG. 9A is a close-up view of the roof attachment connected to the roof.
Figure 9B:
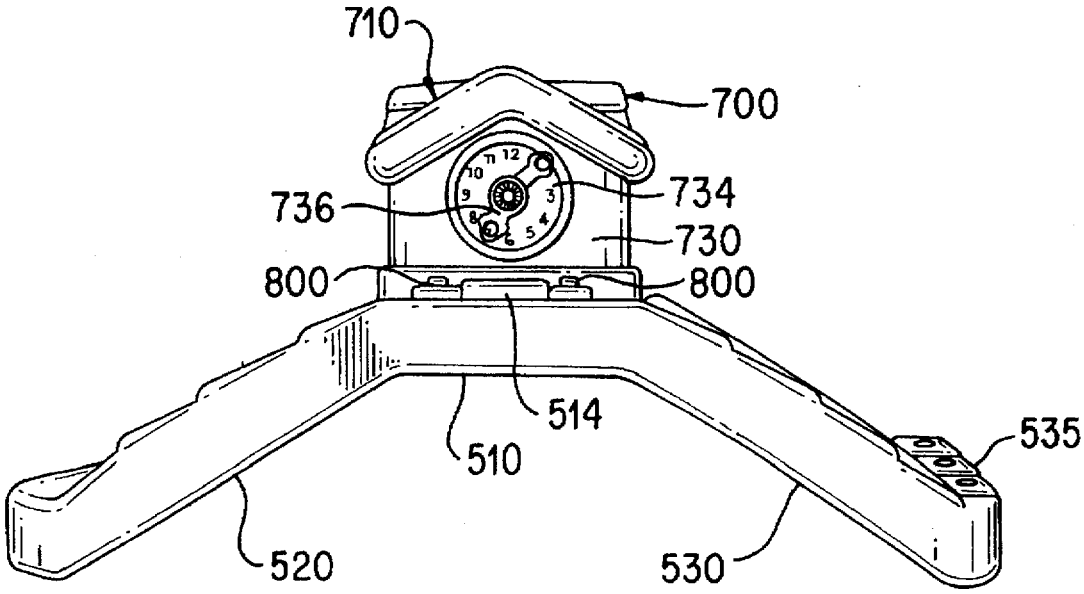
FIG. 9B is a front view of the front edge of the roof.

As depicted in FIGS. 8–9, the roof (500) preferably includes a substantially horizontal portion (510), a left downward sloping section (520) and a right downward sloping section (530) each of which terminate at a small, substantially horizontal ledge surface (521, 531). Disposed on the left sloping roof section is a large rectangular recessed area (524) on which books or other supplies may be placed. In a portion of the recessed area (524) is a large blackboard (522). Below the blackboard and disposed on the left ledge surface (521) are elongated recesses (523) for holding chalk, erasers, pencils and other school supplies. Surrounding the blackboard (522) on one or more sides and within the recessed area (524) are textured pictorials (525) for crayon rubbings.

A large, substantially rectangular skylight cut-out (532) is disposed on the right downward sloping roof portion (530). This cut-out allows children to stand in the play structure, adds a window/skylight feature, and allows light to enter the play structure. On the perimeter of the skylight cut-out (532) are additional molded-in play surfaces, including a ladder (533), a slide (534), and a series of graduated levels (535) having circular recesses (800) thereon adapted to receive play figures.

A swimming pool area for play or action figures is located at one end of the substantially horizontal portion (510) of the roof (500). The pool area consists of a deep recessed rectangular area which may be filled with water to create a swimming pool (511), molded-in pegs and recesses (800) for play figures to surround the pool, a pivoting diving board (512) and a molded-in pool ladder (513). On the opposite end of the roof is a molded-in picnic table (514) with pegs (800) for play figures on either side.

Between the pool and picnic areas is a gymnasium area, which contains molded-in gym equipment (515). A raised, substantially rectangular roof attachment (700), the exterior of which resembles a bell or clock tower roof typically found on old schoolhouses, together with a rectangular recess (516) in the horizontal portion of the roof (510) define the gymnasium area.

The raised roof attachment (700) preferably has an A-frame outline on all four sides, realistic shingles (710), a door archway to the pool area (740) and a rear wall (720) and a side wall (730) which extend down from the roof attachment (700) to form a semi-enclosed gym area. The interior side of the rear and side walls have affixed thereto decals (722, 732) depicting gymnasium scenes. Decals depicting a ringing bell (724) and a clock face (734) are affixed to the exterior of the rear and side walls of the roof attachment (700). Movable hands (736), which rotate around a horizontal axis, are affixed to the clock face. While the roof attachment (700) is preferably connected to the main roof (500) by means of a friction fit, any suitable connection means is contemplated.

Although the disclosed play-inside play structure is specifically contemplated for use with Fisher Price Little People®, any play or action figure can be used in conjunction with this play structure. The play surfaces can be integrally molded, separately formed and attached, and fabricated by blow molding, rotational molding or any other suitable process.

In the preferred embodiment described above, the play structure is primarily manufactured using rotomolded low density polyethylene. Other suitable materials and/or molding or manufacturing methods, including blow molding, may be used to manufacture any or all of the components. Also, in the preferred embodiment, the various pieces (i.e., walls, roof, door panel, roof attachment, etc.) are generally of a hollow construction; however, they may be molded or formed as solid parts from any suitable material, including but not limited to plastic, wood or metal. Preferably, all the edges of the playhouse and features therein are rounded to eliminate the risk of cuts and scratches to children using the playhouse. Although the play structure of the present invention is designed for indoor use, it may also be used outdoors if constructed with suitable materials, such as rotomolded polyethylene.

The front and rear walls (100, 200) are preferably connected to the side walls (300, 400) and roof (500) by a tongue and groove mechanism having snap or interlock detail to prevent unwanted lateral and vertical displacement of the walls and roof once the play structure is assembled. Such a mechanism is fully described in U.S. application Ser. No. 08/516,451, the disclosure of which is herein incorporated by reference. However, any suitable mechanism for securely connecting the walls to each other and to the roof is also contemplated.

While the play structure of the preferred embodiment has a "schoolhouse" theme, any other thematic-type play-inside play structure having a plurality of thematically-related play surfaces thereon is also contemplated. With the exception of the roof attachment (700), the play structure is intended for permanent assembly by an adult.

What is claimed is:

1. A play structure, comprising:

a plurality of wall members securably connectable to form a substantially enclosed play structure, said play structure defining an interior space, wherein the play structure has a first scale proportioned to accommodate a child in said interior space; and a play figurine having a circular base and a center portion having an indentation, and wherein at least one of said wall members has a contoured portion forming a figurine play area to support said play figurine and having a second scale smaller than said first scale.

2. The play structure of claim 1 further comprising a roof, wherein at least two of said wall members are substantially vertically disposed and have a bottom surface adapted to contact a ground surface and a top surface securably connectable to said roof.

3. The play structure of claim 1 further comprising a door panel, and wherein one of said wall members defines a doorway opening and said door panel is hingedly mounted at said doorway opening.

4. The play structure of claim 3 wherein said roof panel has a plurality of play surfaces disposed thereon.

5. The play structure of claim 4 wherein said play structure has a substantially planar blackboard disposed thereon.

6. The play structure of claim 1 wherein said play structure and said figurine play area share a schoolhouse theme.

7. A play structure according to claim 1, wherein said figurine play area includes a recess to support said play figurine.

8. A play structure according to claim 1, wherein said figurine play area includes a ledge to support said play figurine.

9. A play structure according to claim 1, wherein said figurine play area includes one of an auditorium, a library, a swimming pool, a picnic area, a gymnasium and a play yard.

10. A play structure according to claim 1, wherein another one of said plurality of wall members has a contour adapted to receive said play figurine.

11. A play structure according to claim 1, wherein said plurality of wall members further define an exterior space and the play structure includes a first passageway disposed in at least one of said plurality of wall members to accommodate passage, of the child between said interior space and said exterior space, and a second passageway different from said first passageway formed in the play structure to accommodate passage of said play figurine between said interior space and said exterior space, wherein said second passageway has a size insufficient to allow passage of the child between said interior space and said exterior space.

12. A play structure according to claim 11, wherein said first passageway has a first shape and said second passageway has a second shape substantially similar to said first shape.

13. A play structure according to claim 11, further comprising:

a movable member for selectively closing said first passageway, wherein said second passageway is disposed in said movable member.

14. A play structure according to claim 11, wherein said second passageway is disposed in at least one of said plurality of wall members.

15. A play structure, comprising:

a plurality of wall members securably connectable to form a substantially enclosed play structure having a first scale, said play structure having interior surfaces defining an interior space sufficient to accommodate a child;

a roof securably connected to the wall members and having a swimming pool formed therein; and a figurine play area formed in at least one of said wall members and having a second scale smaller than said first scale, wherein said figurine play area includes a plurality of structures to receive and retain a figurine of said second scale during play.

16. A play structure according to claim 15, wherein said figurine play area is a playground and said plurality of structures include at least one of a slide, a pass-through tunnel, a hanging tire, a hopscotch outline, a ladder and a merry-go-round.

17. A play structure according to claim 15, wherein said figurine play area is an auditorium and said plurality of structures include at least one of a stage and a ladder.

18. A play structure according to claim 15, wherein said figurine play area is a gymnasium and said plurality of structures include gym equipment.

19. A play structure according to claim 15, wherein said plurality of play structures include at least one of a recessed archway, a ledge, a seat, a table, a passageway, a staircase, a pass-through tunnel, a recess, and circular recess.

20. A play structure according to claim 15, further comprising:

a raised roof attachment disposed on said roof.

21. A play structure according to claim 15, further comprising:

a blackboard disposed on said roof and recesses formed in said roof for receiving implements for use with said blackboard.

22. A play structure according to claim 15, further comprising:

a skylight formed in said roof.

23. A play structure according to claim 15, wherein one of said wall members comprises a door.

24. A play structure according to claim 15, further comprising:

a pathway formed in one of said wall members for receiving a vehicle having said second scale.

25. A kit for forming a play structure, comprising:

a figurine having a base and a first scale; and a plurality of wall members securably connectable to form a substantially enclosed play structure having a second scale larger than said first scale, said play structure defining an interior space sufficient to accommodate a child, wherein at least one of said wall members has a non-planar contour forming a support structure including a raised peg to be received in said base of said figurine to support said figurine, said support structure being proportioned to said first scale.

26. A kit according to claim 25, wherein said support structure further comprises a recess adapted to receive said base of said figurine.

27. A kit according to claim 25, wherein said figurine further includes a center portion including an indentation.

28. A kit according to claim 25, wherein said figurine comprises at least one figurine.

29. A kit according to claim 25, further comprising:

a roof securably connected to said wall members.

30. A kit according to claim 29, further comprising:

a bell tower capable of being securably connected to said roof.

31. A kit according to claim 25, further comprising:

a door capable of being securably connected to at least one of said wall members.

32. A kit according to claim 25, further comprising:

a play vehicle having said first scale, wherein said non-planar contour further forms a play area for said play vehicle.

33. A kit for forming a play structure, comprising:

a figurine having a base portion, a center portion including an indentation, and a first scale; and a plurality of wall members securably connectable to form a substantially enclosed play structure having a second scale larger than said first scale, said play structure defining an interior space sufficient to accommodate a child, wherein at least one of said wall members has a non-planar contour forming a support structure to support said figurine, said support structure being proportioned to said first scale.

34. A kit according to claim 33, wherein said support structure comprises a recess to receive said base portion of said figurine.

35. A kit according to claim 33, whereto said support structure includes a raised peg to be received in said base portion of said figurine.

36. A kit according to claim 33, wherein said figurine comprises at least one figurine.

37. A kit according to claim 33, further comprising:

a roof securably connected to said wall members.

38. A kit according to claim 33, further comprising:

a door capable of being securably connected to at least one of said wall members.

* * * * *